US007535316B2

(12) United States Patent
Tanbakuchi et al.

(10) Patent No.: US 7,535,316 B2
(45) Date of Patent: May 19, 2009

(54) SELF-SUPPORTED STRIP LINE COUPLER

(75) Inventors: Hassan Tanbakuchi, Santa Rosa, CA (US); Michael B. Whitener, Santa Rosa, CA (US); Matthew R. Richter, Santa Rosa, CA (US); Glenn S. Takahashi, Santa Rosa, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 184 days.

(21) Appl. No.: 11/282,061

(22) Filed: Nov. 16, 2005

(65) Prior Publication Data

US 2007/0109071 A1 May 17, 2007

(51) Int. Cl.
*H01P 5/18* (2006.01)

(52) U.S. Cl. ..... 333/115; 333/116

(58) Field of Classification Search ..... 333/115, 333/116, 117

See application file for complete search history.

(56) References Cited

U.S. PATENT DOCUMENTS

| | | | | | |
|---|---|---|---|---|---|
| 3,012,210 | A | * | 12/1961 | Nigg | 333/116 |
| 3,390,356 | A | * | 6/1968 | Ryals et al. | 333/115 |
| 3,416,102 | A | * | 12/1968 | Hamlin | 333/115 |
| 3,478,281 | A | * | 11/1969 | Jeong | 333/116 |
| 4,139,827 | A | | 2/1979 | Russell | |
| 4,547,753 | A | | 10/1985 | Chapell | |
| 4,641,111 | A | | 2/1987 | Chapell | |
| 5,347,244 | A | * | 9/1994 | Monti | 333/115 |
| 5,499,001 | A | | 3/1996 | Degun et al. | |
| 6,624,722 | B2 | | 9/2003 | Wang et al. | |
| 6,731,244 | B2 | | 5/2004 | Killen et al. | |
| 6,794,954 | B2 | | 9/2004 | Gurvich et al. | |
| 6,822,532 | B2 | | 11/2004 | Kane et al. | |

* cited by examiner

*Primary Examiner*—Benny Lee

(57) ABSTRACT

A coupler assembly has first and second conductors with first and second dielectric supports extending along a coupling section and supporting the first and second conductors at a support section.

17 Claims, 4 Drawing Sheets

SELF-SUPPORTED STRIP LINE COUPLER

CROSS-REFERENCE TO RELATED APPLICATION

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

Couplers are used in high-frequency devices to add or remove power from one conductor to another conductor. A variety of couplers have been developed, including branch-line couplers, Bethe couplers, and Lange couplers. Couplers have been developed based on a variety of transmission line structures, including waveguide transmission structures, coaxial transmission structures, and strip-line transmission structures. Generally, a portion of a first signal in one conductor is coupled to the other conductor to produce a second signal that propagates opposite to the direction of propagation in the first conductor. Ideally, any signal propagating in the second conductor in the same direction as the first signal cancels itself out in the forward direction but not in the reverse direction. In reality, some energy will propagate in the second conductor in the same direction as the first. The directivity of a coupler is a figure of merit that indicates the energy in the second conductor propagating in the desired direction (i.e. opposite the direction of propagation in the first conductor) relative to the energy propagating in the opposite direction.

Many couplers are based on a planar geometry that has two conductors defined in close proximity on a non-conductive substrate, such as a thin-film substrate, thick-film substrate, printed circuit board ("PCB") substrate, or semiconductor wafer. Unfortunately, electromagnetic energy from the conductors couples into the substrate material, resulting in loss. Similarly, coupling energy into the substrate typically degrades directivity of the coupler.

Couplers have been designed that suspend the conductors of the coupler in air, or suspend one of the conductors in air and define the second conductor on a substrate. Dielectric beads, pins, or pegs are used to support conductors of a coupler in a package (housing) of a microcircuit; however, such couplers are specific to a particular package because the supports are placed in the package with a high degress of precision or adjustability. This increases manufacturing costs because new pegs are designed for each new package configuration. Furthermore, the material of the support material (pegs) preferentially retards the propagation of the even transmission mode relative to the odd transmission mode, which degrades performance of the coupler. It is also difficult to reduce the size of such designs to produce couplers suitable for very high frequency operation.

Thus, couplers that avoid the problems of the prior art are desirable.

BRIEF SUMMARY OF THE INVENTION

A coupler assembly has first and second conductors with first and second dielectric supports extending along a coupling section and supporting the first and second conductors at a support section.

DETAILED DESCRIPTION OF THE EMBODIMENTS

I. An Exemplary Coupler Assembly

Figure 1A:
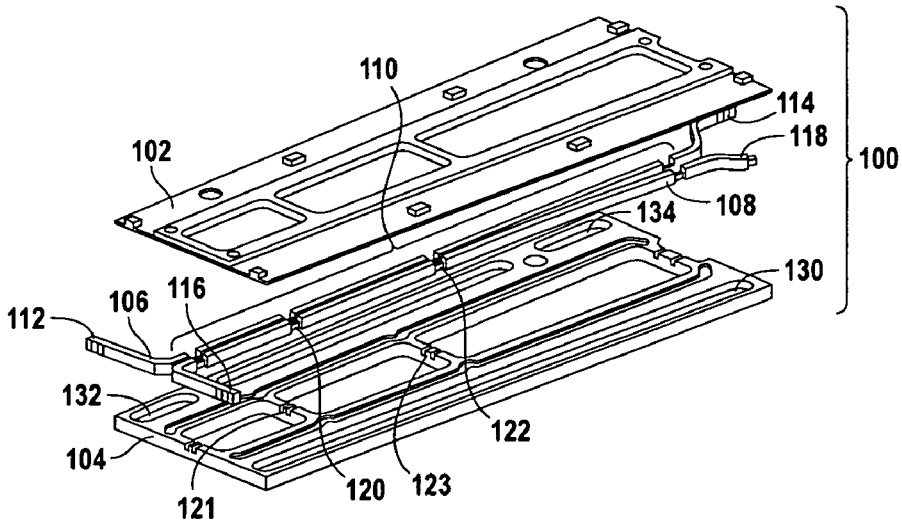
FIG. 1A shows an exploded view of a coupler assembly according to an embodiment of the invention.

FIG. 1A shows an exploded view of a coupler assembly 100 according to an embodiment of the invention. The coupler assembly 100 includes a first dielectric support 102, a second dielectric support 104, a first conductor 106, and a second conductor 108. The first conductor 106 couples to the second conductor 108 over a "coupling section" 110. The coupling section 110 is that portion of the coupler assembly where the first and second conductors are essentially next to each other, and this type of coupler is commonly referred to as an "edge-coupled strip-line" coupler. These portions of coupler conductors are often referred to as "coupler antennas." The terms "coupler" and "coupler assembly" are used as terms of convenience, and include various electronic devices, such as couplers, power splitters, power combiners, and Lange couplers that generally have two conductors in proximity to each other over a coupling section for the purpose of intentionally transferring power from one conductor to another.

The dimensions of the coupler assembly are determined by a variety of factors, including maximum and minimum operating frequencies, impedance, and the amount of coupling desired. The maximum operating frequency is generally determined by the distance between the ground planes, with an inverse relationship between the distance and the maximum frequency (i.e., the smaller the distance, the higher the operating frequency). An exemplary coupler having 15 dB coupling from about three GHz to about one hundred GHz has a spacing between the ground planes of about 0.8 mm, a conductor height of about 0.4 mm, and a coupling section about 30 mm long.

The first and second dielectric supports position the first and second conductors relative to each other along substantially the entire coupling length, and will position the conductors relative to a conductive surface (ground plane) of a microcircuit housing when the coupler assembly 100 is packaged.

The ends of the first and second conductors 106, 108 will form the ports 112, 114, 116, 118 of the packaged coupler. In a particular embodiment, the signal is provided to an input port 112 and is transmitted along the first conductor 106 to an output port 114. A portion of the signal is coupled to the second conductor 108, and is transmitted to a coupled port 116. A termination, such as a fifty-ohm resistive load (see FIG. 3A, ref. num. 312), is optionally provided in the packaged coupler and is connected to the fourth (terminated) port 118. Alternatively, the fourth port 118 is not terminated in the packaged coupler, and the fourth port is brought out to a package feedthrough, as are the other ports.

The center conductors 106, 108 include compensation features 120, 122 in the coupling section 110. The compensation features 120, 122 have a cross section that is reduced from the cross section of the other portion of the coupler antennas. The compensation features 120, 122 cooperate with notches 121, 123 in the dielectric supports 102, 104 to avoid impedance discontinuities along the coupling section 110. In a particular embodiment, the first dielectric support is different than the second dielectric support in that the notches are only formed in the lower dielectric support 104, and the upper dielectric support 102 basically covers the conductors secured in the lower dielectric support. Alternatively, the first dielectric support is essentially a mirror image of the second dielectric support, and in some embodiments, the first dielectric support is the same as the second dielectric support.

Pockets 130, 132, 134 are optionally formed in the dielectric support 104. The pockets are filled or partially filled with an electromagnetic absorber, such as what is commonly referred to as "polyiron," which is very fine iron or other particles dispersed in a resin (e.g. epoxy) matrix. In a particular embodiment, an epoxy-based polyiron precursor is poured into the pockets in the dielectric support(s) to suppress unwanted electromagnetic radiation to or from the coupler.

In a particular embodiment, the first dielectric support 102 and second dielectric support 104 are machined from a polymer (plastic) or fabricated from other dielectric material. It is generally desirable that the dielectric material chosen for the dielectric supports be suitably rigid and strong to provide mechanical strength to coupler assemblies during handling, and have a low dielectric constant and low dielectric loss to avoid degrading transmission characteristics of the coupler antennas. A suitable example is cross-linked polystyrene, an example of which is sold under the name Rexolite™ by C-lec Plastics, Inc. In a particular embodiment, the dielectric supports are machined Rexolite™ 1422™ approximately 0.6 mm thick for the lower support and about 0.2 mm thick for the upper support. Alternatively, the dielectric supports arc east or molded from a suitable polymer resin or other dielectric material.

Figure 1B:
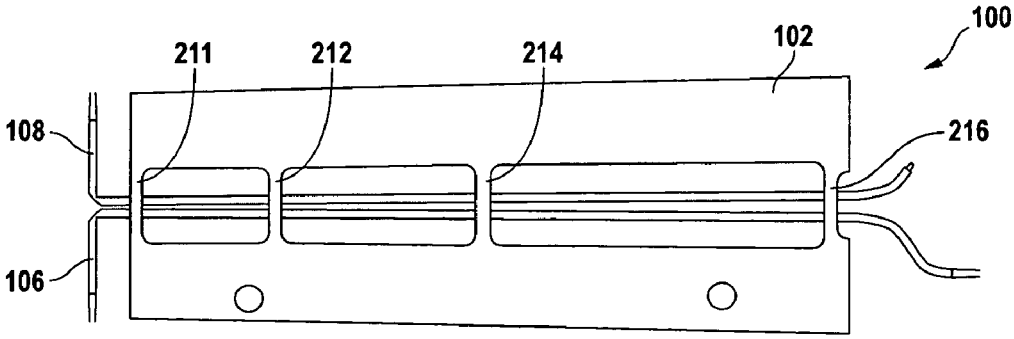
FIG. 1B shows a plan view of the coupler assembly of FIG. 1A.

FIG. 1B shows a plan view of die "bottom" of the coupler assembly 100 of FIG. 1A. The center conductors 106, 108 are held between the first dielectric support l02 and the second dielectric support 104 (not shown in FIG. 1B) in precise relation to each other at support sections 211, 212, 214, 216. The dielectric material of the dielectric supports surround the coupler conductors 106, 108 at the support sections 211, 212, 214, 216. The dielectric supports extend along the coupling section to hold the coupler conductors at the desired separation and alignment, and provides mechanical strength and rigidity to the coupler assembly. The dielectric supports in combination with the antennas provide a coupler assembly 100 that can be used in a variety of microcircuit housings without having to use housing-specific dielectric pegs or standoffs. This greatly simplifies design and manufacturability of the microcircuit housing and reduces cost of fabrication of packaged couplers.

Figure 1C:
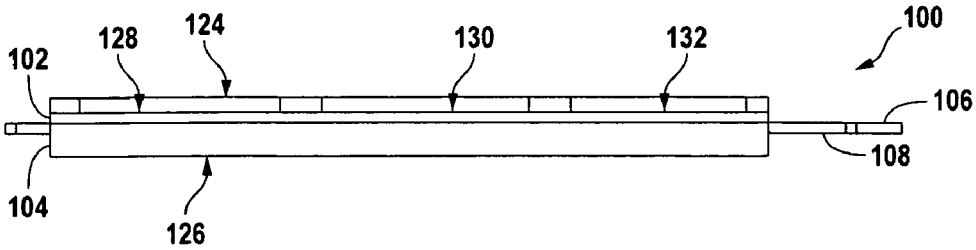
FIG. 1C shows a side view of the coupler assembly of FIG. 1A.

FIG. 1C shows a side view of the coupler assembly 100 of FIG. 1A. The first dielectric support 102 and second dielectric support 104 hold the first 106 and second 108 center conductors at a precise height relative to the top 124 of the first dielectric support 102 and the bottom 126 of the second dielectric support. Relieved surfaces 128, 130, 132 of the first dielectric support 102 cooperate with flat springs (not shown) that press against the lid of a microcircuit package to hold the coupler assembly 100 against the microcircuit housing (see FIG. 3A, ref. num. 302), allowing convenient removal and replacement or repair of the coupler assembly, if necessary.

The position of the antennas is held by the dielectric supports, and is not dependent on any particular housing configuration. This relieves the package from having to be precisely machined to hold the coupler antennas to obtain the desired electrical performance.

II. Details of a Coupler Assembly and Compensation Features

Figure 2A:
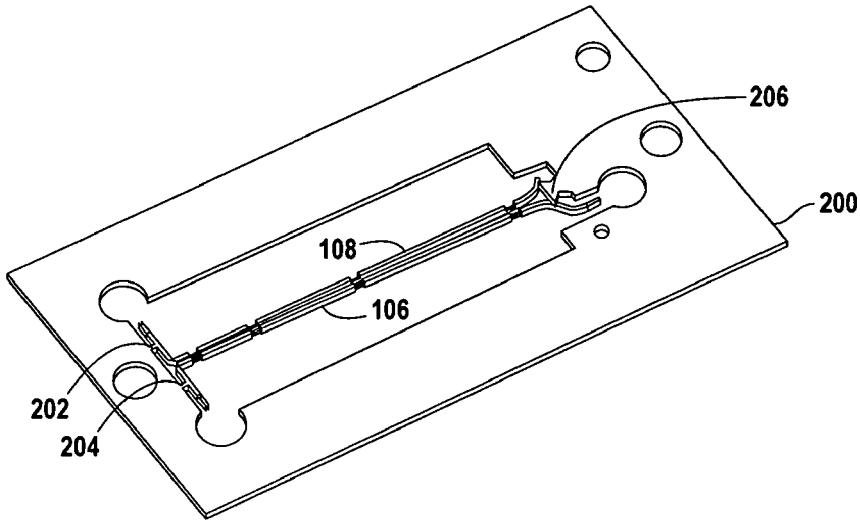
FIG. 2A shows a coupler conductor blank according to an embodiment of the invention.

FIG. 2A shows a coupler conductor blank 200 according to an embodiment of the invention. The coupler conductor blank 200 is a sheet of metal, and in a particular embodiment is a sheet of beryllium-copper about 0.4 mm thick. The first conductor 106 and second conductor 108 for the coupler are formed by electro-discharge machining ("EDM"); however, any suitable machining process is alternatively used. Tabs 202, 204, 206 temporarily attach the first and second conductors to the coupler conductor blank. After machining, the coupler conductor blank 200 is optionally plated, such as with gold.

In a particular embodiment, the first and second dielectric supports (see FIG. 1A, ref. nums. 102, 104) are assembled on the first and second conductors 106, 108 before they are separated from the coupler conductor blank 200. This provides support to the conductors during handling, in particular, during the de-tabbing (removal from the blank) and trimming processes. A cyanoacrylate adhesive is used to attach the dielectric supports to the conductors and themselves. Alternatively, the first and second dielectric supports are attached using diffusion bonding, ultrasonic bonding, or solvent bonding, or by using an alternative adhesive.

Figure 2B:
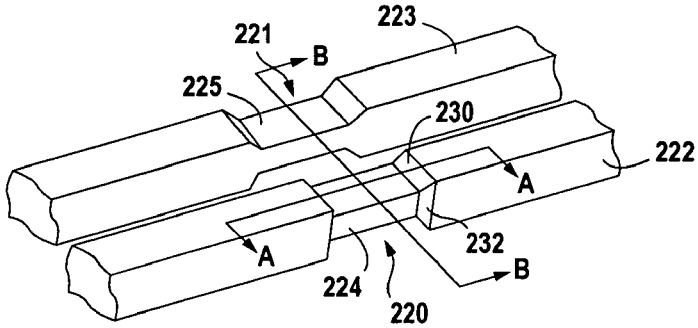
FIG. 2B shows an isometric view of a portion of coupler conductors according to an embodiment of the invention.

FIG. 2B shows an isometric view of compensation features 220, 221 on coupler antennas 222, 223 according to an embodiment of the invention. The coupler conductors are supported by the dielectric supports at the compensation features. Although the dielectric supports are made from low-dielectric material, the dielectric constant of the material is greater than the air that surrounds the other portions of the coupler conductors. This can create an impedance discontinuity in the conductors. The compensation features reduce the impedance discontinuity where the dielectric material supports the conductors by reducing the cross section of the conductor.

The transition to the reduced cross sectional area creates an additional series inductance that is ideally compensated by a shunt capacitance. The increased dielectric constant of the dielectric material supporting the reduced cross sectional areas (i.e. the compensation features) provides a shunt capacitance that compensates for the increased inductance, thus minimizing the impedance discontinuity.

In addition to optimizing the impedance continuity through the support sections of the conductors, encapsulating (i.e. surrounding) the conductors with the dielectric material of the supports provides coupler assemblies suitable for high-frequency operation. As operating frequency is increased, the size of the components are decreased to avoid additional unwanted modes of propagation from developing. In a prior-art design, holes are drilled through conductors and dielectric pegs are inserted through the conductors and into receiving holes in the microcircuit housing. Sufficient material must be left on either side of the hole for mechanical rigidity. This is difficult to achieve with the very small conductors used in couplers for operation above about 100 GHz. Material is removed from the surfaces of the conductors to form the compensation features, which is easier than drilling very small holes and fabricating very small dielectric plugs. The encapsulating dielectric material provides mechanical rigidity to the coupler assembly.

The presence of dielectric material between the conductors, as well as between the conductors and the ground planes (see FIG. 3B, ref. nums. 320, 322) means that both the even and odd propagation modes will be affected by the discontinuity, which improves performance relative to dielectric support designs that affect one propagation mode differently than the other. The position of the conductors is fixed by the dielectric supports, which are easily matched to the ground planes of a microcircuit package (see FIG. 3B, ref. nums. 320, 322). This allows the coupler assembly (see FIGS. 1A-1C, ref. num. 100) to be used with a variety of relatively simple microcircuit packages, and provides embodiments of couplers suitable for use up to at least 110 GHz.

The compensation features 220, 221 include reduced sections 224, 225 that are portions of the coupler antennas that have reduced cross sections for a length of about 0.5 mm. In a particular embodiment, most of the coupler antenna 222 has a rectangular cross section about 0.4 mm high by about 0.3 mm wide, and the reduced section 224 has a rectangular cross section about 0.2 mm high by about 0.25 mm wide. These dimensions are merely exemplary. Many other sizes of antennas and reduced portions are alternatively used. The dielectric supports (see FIG. 2D, ref. nums. 226, 228) support the reduced section 224 of the compensation feature.

The compensation feature 220 includes transition portions 230, 232 (and additional, similar, transition portions on the bottom of the reduced section and at the opposite end of the reduced section) that gradually reduce (i.e. taper) the cross section of the coupler antenna to from the reduced section, to further reduce impedance discontinuities where the coupler antennas are supported. In a particular embodiment, the transition portions form an angle of about thirty degrees (30°) from the vertical (see FIG. 2C; however, this angle is merely exemplary. Steeper or more gradual transitions are alternatively used according to the dimensions of the coupler antennas, and the dimensions, configuration, and material of the dielectric supports.

Figure 2C:
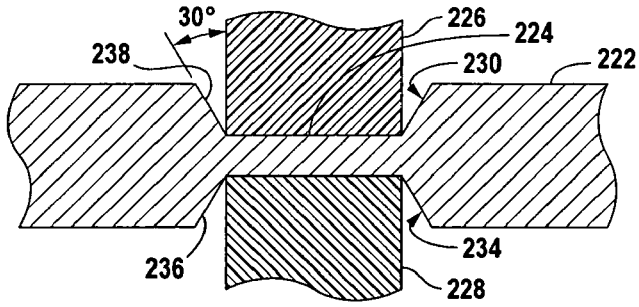
FIG. 2C shows a cross section of a compensation feature of a coupler assembly according to an embodiment of the invention.

FIG. 2C shows a cross section of a compensation feature of a coupler assembly according to an embodiment of the invention. The cross section is essentially taken along section line A-A of FIG. 2B; however, the dielectric supports 226, 228 are not shown in FIG. 28. The coupler antenna 222 has transition portions 230, 234, 236, 238; and reduced section 224.

Figure 2D:
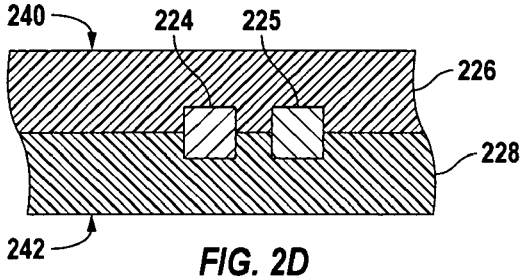
FIG. 2D shows another cross section of the compensation feature shown in FIG. 2D.

FIG. 2D shows another cross section of the compensation feature essentially taken along section line B-B of 2B. The dielectric supports 226, 228 surround the reduced sections 224, 225 of the coupler antennas and support the coupler antennas selected distances from the upper and lower dielectric surfaces 240, 242 so that when the coupler assembly is packaged in a microcircuit housing, the coupler antennas will be held the selected distances from the ground planes (floor and ceiling) of the microcircuit housing and lid.

III. An Exemplary Packaged Coupler Assembly

Figure 3A:
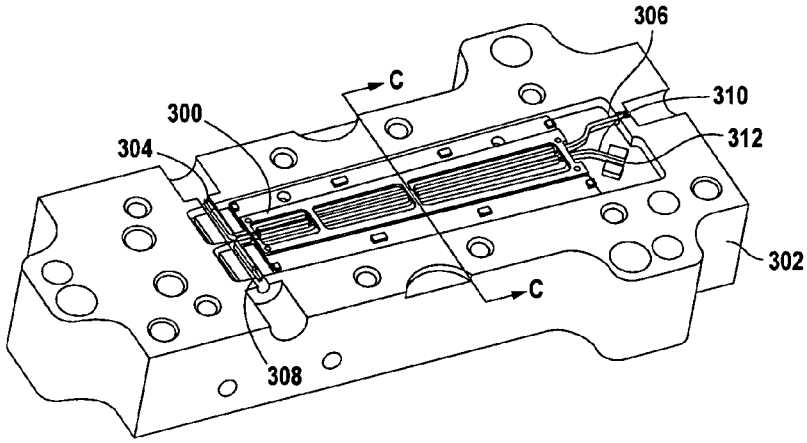
FIG. 3A shows an isometric view of a coupler in a microcircuit housing according to an embodiment of the invention.

FIG. 3A shows an isometric view of a coupler assembly 300 in a microcircuit housing 302 according to an embodiment of the invention. Coaxial adaptors will be added to the microcircuit housing at the input port 304, output port 306, and coupled port 308. The fourth port 310 is terminated in a resistive load 312, which in a particular embodiment is a 50-ohm resistor selected to provide a high-quality (i.e. low capacitance, low inductance) load up to least about 90 GHz.

Figure 3B:
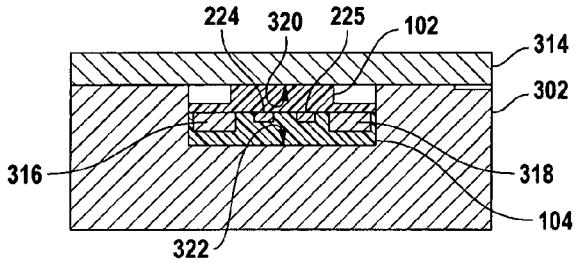
FIG. 3B shows a cross section of a packaged coupler essentially taken along section line C-C of FIG. 3A.

FIG. 3B shows a cross section essentially taken along section line C-C of FIG. 3A. A lid 314 (not shown in FIG. 3A) is attached to the microcircuit 302 using conductive adhesive. Alternatively, the lid is screwed or bolted onto the microcircuit housing with an intervening conductive gasket (not shown), or is attached using other means. The lid and microcircuit housing have conductive surfaces, and in a particular embodiment are gold-plated aluminum. The reduced sections 224, 225 are supported by the dielectric supports 102, 104. Pockets (see, e.g., FIG. 1A, ref. num. 130) in the dielectric support 104 have been filled with polyiron 316, 318 or other electromagnetic absorbing material. The dielectric supports 102, 104 support the coupler antennas a selected distance from the ground planes 320, 322 provided by the lid 314 and microcircuit housing 302 to form a strip-line coupler.

IV. Simulation and Test Results

Figure 4A:
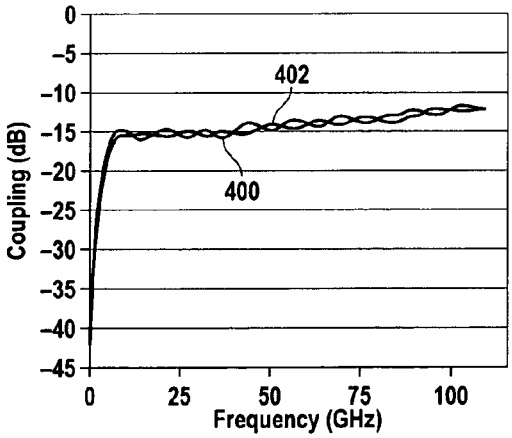
FIG. 4A shows the coupling of the modeled dielectric-supported coupler compared to the coupling of an ideal coupler of similar dimensions.

A dielectric-supported coupler substantially in accordance with the coupler assembly of FIG. 1A was modeled using High Frequency Structure Simulator ("HFSS")™, version 5.6, available from Agilent Technologies, Inc. An ideal coupler, in other words a coupler of similar configuration having coupler antennas without compensation features, suspended in air with no physical support, was also modeled. FIG. 4A shows the coupling ($S_{31}$) of the modeled dielectric-supported coupler 400 compared to the coupling of an ideal coupler 402 of similar dimensions. These plots show that the dielectric-supported coupler has performance similar to an ideal coupler up to at least 100 GHz.

Figure 4B:
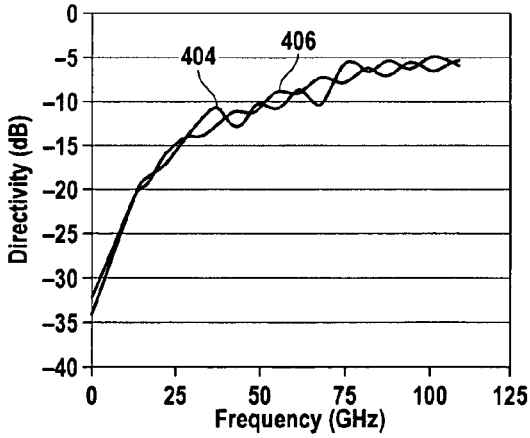
FIG. 4B shows directivity plots for the dielectric-supported coupler modeled in FIG. 4A and for the ideal coupler modeled in FIG. 4A.

FIG. 4B shows directivity plots ($S_{24}/S_{21}$) for the dielectric-supported coupler 404 modeled in FIG. 4A and for the ideal coupler 406 modeled in FIG. 4A. The dielectric-supported coupler compares favorably with the ideal coupler, illustrating the advantages obtained by circumferential dielectric supports and transitions.

Figure 5A:
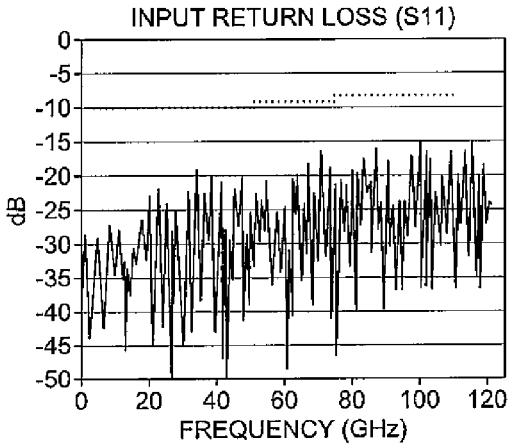
FIG. 5A shows the measured input return loss for a packaged coupler according to an embodiment.

A packaged coupler substantially in accordance with FIG. 3A was fabricated and tested using a vector network analyzer. FIG. 5A shows the measured input return loss ($S_{11}$) for the packaged coupler. Excellent input return loss of better than −15 dB up to 110 GHz was achieved. The input return loss was comparable to a prior-art packaged coupler of similar electrical design using dielectric pegs, even though the coupler according to an embodiment was significantly less expensive to fabricate.

Figure 5B:
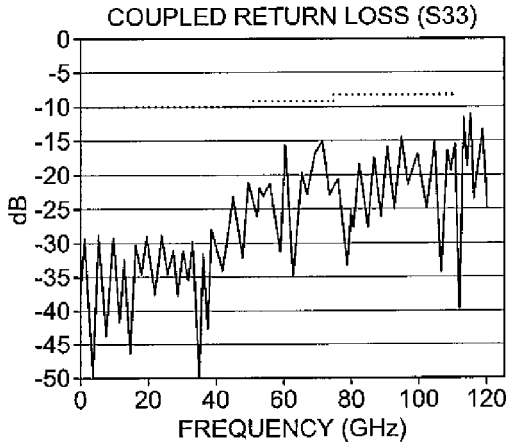
FIG. 5B shows the measured coupled return loss of the packaged coupler of FIG. 5A.

FIG. 5B shows the measured coupled return loss ($S_{33}$) of the packaged coupler of FIG. 5A. As with the input return loss, the measured coupled return loss of the packaged coupler according to an embodiment was comparable to the coupled return loss of a prior-art packaged coupler of similar electrical design using dielectric pegs.

Figure 5C:
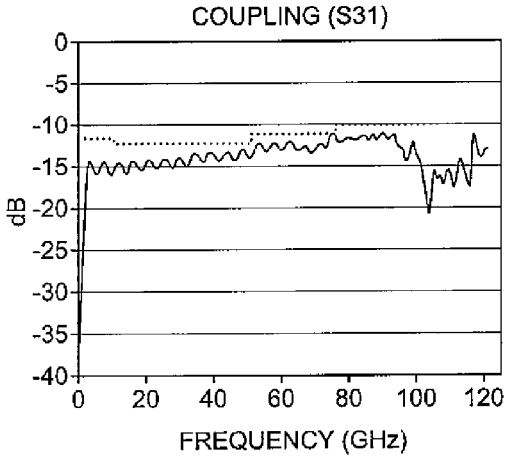
FIG. 5C shows the measured coupling of the packaged coupler of FIG. 5A.
Figure 5D:
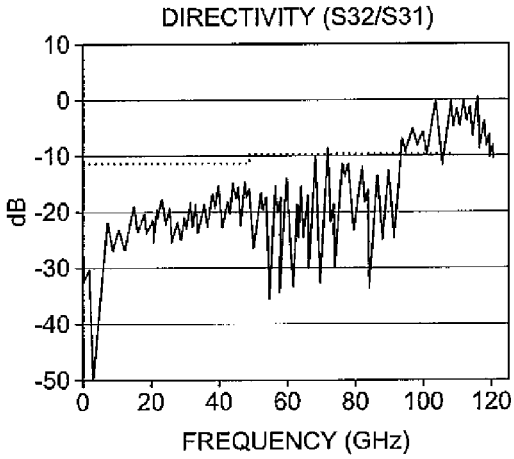
FIG. 5D shows the measured directivity of the packaged coupler of FIG. 5A.

FIG. 5C shows the measured coupling ($S_{31}$) of the packaged coupler of FIG. 5A, and FIG. 5D shows the measured directivity ($S_{32}/S_{31}$) of the packaged coupler of FIG. 5A. The directivity of the dielectric-supported packaged coupler according to the embodiment was substantially the same as the directivity of the prior-art packaged coupler using dielectric pegs. It is expected that refinements in the design of the packaged coupler will provide directivity better than −10 dB up to 110 GHz.

While the preferred embodiments of the present invention have been illustrated in detail, it should be apparent that modifications and adaptations to these embodiments might occur to one skilled in the art without departing from the scope of the present invention as set forth in the following claims. For example, embodiments of the invention are used to fabricate high-performance, low-cost power dividers and Lange couplers and dual-directional couplers.

What is claimed is:

1. A coupler assembly comprising:

a first conductor;

a second conductor proximate to the first conductor along a coupling section;

a first dielectric support extending along the coupling section; and a second dielectric support extending along the coupling section, the first dielectric support cooperating with the second dielectric support so as to surround the first conductor and the second conductor at a first support section; wherein one of the first dielectric support and the second dielectric support comprises a polymer, and the polymer comprises one of a machined polymer and a cast polymer.

2. A coupler assembly comprising:

a first conductor;

a second conductor proximate to the first conductor along a coupling section;

a first dielectric support extending along the coupling section; and a second dielectric support extending along the coupling section, the first dielectric support cooperating with the second dielectric support so as to surround the first conductor and the second conductor at a first support section; wherein: the first dielectric support and the second dielectric support surround the first conductor and the second conductor at a second support section; and one of the first dielectric support and the second dielectric support comprises one of: a machined polymer and a cast polymer.

3. The coupler assembly of claim 2 wherein the first conductor and the second conductor are surrounded by air except for at the first support section and the second support section.

4. The coupler assembly of claim 2 further comprising:

a microcircuit housing providing a first ground plane; and a microcircuit lid providing a second ground plane, the first dielectric support and the second dielectric support holding the first conductor and the second conductor a first selected distance from the first ground plane and a second selected distance from the second ground plane so as to form a slotline coupler.

5. The coupler assembly of claim 4 further comprising a termination connected to a port of the slotline coupler.

6. A coupler assembly comprising:

a first conductor;

a second conductor proximate to the first conductor along a coupling section; a first dielectric support extending along the coupling section; and a second dielectric support extending along the coupling section, the first dielectric support cooperating with the second dielectric support so as to surround the first conductor and the second conductor at a first support section; wherein: the first conductor comprises a first compensation feature at the support section and the second conductor comprises a second compensation feature; and one of the first dielectric support and the second dielectric support comprises one of: a machined polymer and a cast polymer.

7. The coupler assembly of claim 6 wherein the first compensation feature comprises a transition portion to a reduced section of the first conductor.

8. The coupler assembly of claim 7 wherein at least one of the first dielectric support and the second dielectric support have notches in the support section supporting the reduced section.

9. The coupler assembly of claim 6 wherein the first conductor and the second conductor are surrounded by air except for at the first dielectric support and the second dielectric support.

10. The coupler assembly of claim 6 further comprising:

a microcircuit housing providing a first ground plane; and a microcircuit lid providing a second ground plane, the first dielectric support and the second dielectric support holding the first conductor and the second conductor a first selected distance from the first ground plane and a second selected distance from the second ground plane so as to form a slotline coupler.

11. The coupler assembly of claim 10 further comprising a termination connected to a port of the slotline coupler.

12. A coupler assembly comprising:

a first conductor;

a second conductor proximate to the first conductor along a coupling section;

a first dielectric support extending along the coupling section; and a second dielectric support extending along the coupling section, the first dielectric support cooperating with the second dielectric support so as to surround the first conductor and the second conductor at a first support section wherein at least one of the first dielectric support and the second dielectric support include pockets filled with an electromagnetic absorbing material.

13. The coupler assembly of claim 12 wherein at least one of the first dielectric support and the second dielectric support comprises machined polymer.

14. The coupler assembly of claim 12 wherein at least one of the first dielectric support and the second dielectric support comprises cast polymer.

15. The coupler assembly of claim 12 further comprising:

a microcircuit housing providing a first ground plane; and a microcircuit lid providing a second ground plane, the first dielectric support and the second dielectric support holding the first conductor and the second conductor a first selected distance from the first ground plane and a second selected distance from the second ground plane so as to form a slotline coupler.

16. The coupler assembly of claim 15 further comprising a termination connected to a port of the slotline coupler.

17. The coupler assembly of claim 12 wherein the first conductor and the second conductor are surrounded by air except for at the first dielectric support and the second dielectric support.

* * * * *